United States Patent [19]

Chang

[11] 4,048,121

[45] Sept. 13, 1977

[54] LOW TEMPERATURE METAL CLEANING COMPOSITION

[75] Inventor: Edward H. Chang, Burnsville, Minn.

[73] Assignee: Fremont Industries, Inc., Shakopee, Minn.

[21] Appl. No.: 761,582

[22] Filed: Jan. 24, 1977

[51] Int. Cl.[2] ..... C11D 1/825; C11D 3/43; C23G 1/14; C23G 5/02

[52] U.S. Cl. ..... 252/527; 252/89 R; 252/135; 252/139; 252/156; 252/158; 252/DIG. 1

[58] Field of Search ..... 252/89, 111, 114, 118, 252/135, 139, 156, 158, 527, DIG. 1

[56] References Cited

U.S. PATENT DOCUMENTS

| | | | |
|---|---|---|---|
| 2,104,385 | 1/1938 | Hendrey | 252/139 X |
| 2,992,995 | 7/1961 | Arden | 252/158 X |
| 3,222,201 | 12/1965 | Boyle | 252/153 X |
| 3,255,118 | 6/1966 | Carroll | 252/135 X |
| 3,705,856 | 12/1972 | Sedliar | 252/156 |
| 3,707,506 | 12/1972 | Lozo | 252/139 |
| 3,870,647 | 3/1975 | Travers | 252/118 |
| 3,927,970 | 12/1975 | Ciko | 8/137 |
| 3,948,819 | 4/1976 | Wilde | 252/545 |
| 3,985,670 | 10/1976 | Berg | 252/117 |
| 3,994,818 | 11/1976 | Loo | 252/171 |

FOREIGN PATENT DOCUMENTS

| | | | |
|---|---|---|---|
| 698,560 | 11/1964 | Canada | 252/139 |

*Primary Examiner*—Dennis L. Albrecht
*Attorney, Agent, or Firm*—Orrin M. Haugen

[57] ABSTRACT

Metal cleaning formulation for the preparation of low temperature-low foam aqueous metal cleaning and polishing baths. The formulation includes an alkaline builder consisting of sodium metasilicate together with sodium hydroxide, sodium carbonate, or mixtures thereof. The system includes sodium gluconate, the tetrasodium salt of ethylenediaminetetraacetic acid, kerosine, and a biodegradable wetting agent system. The wetting agent system utilizes a mixture of linear primary alcohol polyethers and a linear alcohol alkoxylate, with the linear primary alcohol polyethers having cloud points of about 40° C. and 26° C. respectively, and with the linear alcohol alkoxylate having a cloud point of about 20° C. The formulation is free of either poly or orthophosphates.

3 Claims, No Drawings

LOW TEMPERATURE METAL CLEANING COMPOSITION

BACKGROUND OF THE INVENTION

The present invention relates generally to an improved metal cleaning composition, and more particularly to a formulation for preparing aqueous metal cleaning and polishing baths. The formulation is ecologically desirable, with a capability of effective use at relatively low temperatures, and furthermore is free of poly or orthophosphates which tend to require added effort during chemical effluent treatment.

The formulation of the present invention, in aqueous solution, is useful as a cleaner-degreaser for ferrous and non-ferrous metals. The formulation is ideally suited for cleaning metal surfaces, and is effective for the removal of oils, lubricants, rust preventatives, and other processing soils from the surfaces of metallic pieces or parts, such as steel, stainless steel, iron, aluminum, zinc, copper, brass and other ferrous and non-ferrous metals and alloys.

Metal surface cleaners and degreasers most commonly used are effective only when the operating temperatures are maintained above 65° C., and frequently require working solution temperatures in the range of 80° C. - 95° C. Furthermore, the metal cleaner-degreasers in common use at this time require high concentrations in the working solutions in order to effect thorough cleaning and saponification of fatty acid soils or otherwise form stable emulsions. The utilization of these heavier concentrations, of course, provide additional energy requirements at chemical effluent treatment centers. Furthermore, if operating temperatures are lowered for conventional metallic cleaner-degreaser solutions, high foam formation normally occurs, thus rendering the materials unsuited for use at these lower temperatures.

As has been indicated, the wetting agents employed in the present formulation are biodegradable. The wetting agents have a predetermined and preselected range of cloud points, thus rendering the solutions active and highly effective at low temperatures. The metallic cleaner-degreasers of the present invention accomplish cleaning through solvation of viscous soils and ultimate displacement of fluidized soils from metallic surfaces, with physical or mechanical aids being utilized, including sprays, turbulation aids, air agitation, sonic or ultrasonic generators and the like. With such mechanical cleaning aids, it has been found that the formulation provides working solutions with desirable and effective foam height throughout the entire useful life of the working solution, with the foam height being maintained under a broad range of temperatures, including ambient to approximately 65° C.

SUMMARY OF THE INVENTION

Briefly, in accordance with the present invention, the formulation for preparing the aqueous metal cleaning and polishing baths includes an alkaline builder consisting of sodium metasilicate together with an alkaline ingredient selected from the group consisting of sodium hydroxide, sodium carbonate, and mixtures thereof. Sodium gluconate and the tetrasodium salt of ethylenediaminetetraacetic acid are also present, with these materials forming the normal function of dispersant and stabilizer respectively. Kerosine is provided, with this material being simply a distilled hydrocarbon with a boiling point of between about 150° C. and 300° C. A wetting agent system is provided for these components, with the wetting agent system consisting of a mixture of first and second linear primary alcohol polyethers and a linear alcohol alkoxylate. The linear primary alcohol polyethers have cloud points of approximately 40° C. and 26° C. respectively, with the linear alcohol alkoxylate having a cloud point of about 20° C. The individual components of the wetting agent system, each of which is commercially available, are biodegradable.

Therefore, it is a primary object of the present invention to provide an improved formulation for the preparation of aqueous metallic cleaner-degreaser working solutions, with the formulation containing an alkaline builder, dispersant, stabilizer, and a biodegradable wetting agent system, with the formulation being free of either poly or orthophosphates.

It is a further object of the present invention to provide an improved formulation for the preparation of aqueous metallic cleaner-degreaser working solutions, the working solutions being highly effective at temperatures ranging from as low as ambient up to approximately 65° C.

It is yet a further object of the present invention to provide an improved formulation for the preparation of aqueous metallic cleaner-degreaser working solutions, which provides working solutions having the capability of maintaining effective foam heights at a wide range of temperatures, and with the foam height being maintained during essentially the entire useful life of the working solution.

Other and further objects of the present invention will become apparent to those skilled in the art upon a study of the following specification and appended claims.

DESCRIPTION OF THE PREFERRED EMBODIMENT

Turning now to the individual components present in the formulation, each will be discussed individually.

A. The Alkaline Builder

As has been indicated, the alkaline builder consists of sodium metasilicate together with an alkaline ingredient selected from the group consisting of sodium hydroxide, sodium carbonate, and mixtures thereof. Each component, when present, serves a particular function.

1. Sodium Metasilicate

The alkaline builder normally totals approximately 60 percent of the concentrate. Sodium metasilicate is normally combined with either sodium hydroxide, sodium carbonate or mistures thereof, and when so combined, the total amount of the alkaline builder is normally in the range of about 60 percent of the total. Sodium metasilicate is present for the purpose of neutralizing acidic soils, suspending fine soil particles in the working solution, and further functions to inhibit chemical attack on the metallic surfaces, especially surfaces of non-ferrous metals. Sodium metasilicate ($Na_2SiO_3$) is normally characterized by the following weight ratio:

$Na_2O$ :51.0
$SiO_2$ :46.5
$H_2O$ :0.5

Sodium metasilicate is commercially available from a wide variety of sources.

2. Sodium Hydroxide

This component is present for neutralizing acidic soils, thereby converting such materials to either water soluble or water dispersible form. As has been indicated, sodium hydroxide is desirable for certain applications, but is not an essential element in the present working solutions.

3. Sodium Carbonate

This material is present as an alkaline builder and to maintain alkalinity of the working solutions during the useful life thereof. Since the cost of sodium carbonate is less than that of sodium metasilicate, it can be utilized to lower the overall cost of the formulation.

4. Sodium Gluconate

Sodium gluconate ($NaC_6H_{11}O_7$) is employed to disperse mineral soils, remove fine metallic particles (frequently referred to as "smut"), and also to form water soluble iron complexes. Sodium gluconate is normally present in an amount ranging from between about 5 percent and 15 percent by weight in the formulation. Sodium gluconate is commercially available.

B. The Dihydrated Tetrasodium Salt of Ethylenediaminetetraacetic Acid

This component is present in order to condition hard water which may be encountered in the working solutions, and also to stabilize the working solution to avoid the formation of heavy flocs or sledge.

This material is normally present in the formulation in a range of from between about 1.5 percent by weight and 5 percent by weight.

C. Kerosine

Kerosine is normally defined as a distilled hydrocarbon having a boiling point of between about 150° C. and 300° C., and this material is employed in the formulation to provide a cleaning function. Kerosine is normally present in the formulation in an amount ranging from between about 1.5 percent and 3 percent, with heavier quantities normally interfering with the effectiveness of the working solution. For most effective use, deodorized kerosine is employed, with the deodorization process serving to remove impurities and improve the color. Sulfur content is lowered which is of assistance in the cleaning operations, and, of course, a reduction in odor intensity.

D. Wetting Agent System

The wetting agent system employs three components, each of which is biodegradable. Two components are linear primary alcohol polyethers, the first of which has a cloud point of about 40° C., the second having a cloud point of about 26° C. A linear alcohol alkoxylate, also biodegradable, is provided, this material preferably having a cloud point of about 20° C. The mixture of these materials has been found to enhance the effectiveness of the working solutions over a wide range of temperatures, and thus promotes effective cleaning under a wide range of conditions.

The first linear primary alcohol polyether, which is biodegradable, has a cloud point (1 percent solution in water) of about 40° C. The pH of a 10 percent aqueous solution is 6.5. Linear primary alcohol polyethers having these characteristics are commercially available, with one such material being antarox BL-240, available from GAF Corporation, Chemical Division, of New York, N.Y.

The second linear primary alcohol polyether has a cloud point (1 percent solution in water) of approximately 26° C. The pH of a 10 percent aqueous solution is 6.5. The linear primary alcohol polyether is biodegradable. These materials are commercially available, with one such material being antarox BL-225, available from GAF Corporation, Chemical Division, of New York, N.Y.

The remaining component of the wetting agent system is a linear alcohol alkoxylate which has a cloud point of approximately 20° C. in a 1 percent aqueous solution. The pH of a 1 percent aqueous solution is between about 5.5 and 7.0, thus placing this particular wetting agent on the acid side. Linear alcohol alkoxylates are commercially available, with one such material being sold under the designation Poly-Tergent S-305LF from Olin Chemicals, Olin Corporation of Stamford, Conn. Preferably, in the wetting agent system, the individual materials are preferably available within an effective weight ratio range as follows:

The effective range of weight ratios of the materials, the first linear primary alcohol polyether (cloud point about 40° C.), the second linear primary alcohol polyether (cloud point about 26° C.), and the linear alcohol alkoxylate are as follows: 1.5–6.0: 1.5–3.5: 1.0–2.0. It has been determined that the optimum ratio is 3.0:1.5:1.0.

The following specific examples are provided for the formulations:

EXAMPLE 1

| | % by weight |
|---|---|
| Sodium Hydroxide | 40.0 |
| Sodium Metasilicate | 20.0 |
| Sodium Carbonate | 7.0 |
| Sodium Gluconate | 15.0 |
| EDTA, Tetrasodium Salt Dihydrate | 1.5 |
| Linear Primary Alcohol Polyether (Cloud Point About 40° C.) | 1.5 |
| Linear Primary Alcohol Polyether (Cloud Point About 26° C.) | 2.5 |
| Linear Alcohol Alkoxylate (Cloud Point about 20° C.) | 1.0 |
| Deodorized Kerosine | 1.5 |
| | 100.0 |

The above formulation was added to water in an amount of 4 ounces per gallon, and operated at a temperature of about 50° C. for 5 minutes, in a parts washer equipped with a mechanical agitator capable of generating powerful surging action of the working solution. After 5 minutes, oil, grease and dirt were removed from cast iron gear housings in an effective fashion. Experience with this device in cleaning comparable parts previously required treatment at a temperature of approximately 82° C. for a period of 15 minutes, with the formulation being added in a range of 8 ounces per gallon.

EXAMPLE 2

| | % by weight |
|---|---|
| Sodium Metasilicate | 60.0 |
| Sodium Carbonate | 20.0 |
| Sodium Gluconate | 7.5 |
| EDTA, Tetrasodium Salt Dihydrate | 5.0 |
| Linear Primary Alcohol Polyether (Cloud Point About 40° C.) | 3.0 |
| Linear Primary Alcohol Polyether (Cloud Point About 26° C.) | 1.5 |
| Linear Alcohol Alkoxylate (Cloud Point About 20° C.) | 1.0 |
| Deodorized Kerosine | 2.0 |
| | 100.0 |

This formulation was added in an amount equivalent to 1 ounce per gallon of water, and maintained at a temperature of approximately 50° C. Hydraulic motor components fabricated from cast iron and cast aluminum were effectively cleaned in an ultrasonic unit equipped with a magnetostrictive transducer generator in a period of only 2½ mnutes. Previously, a conventional cleaner required a concentration of 4 ounces per gallon and a temperature in the range of 71° C.

EXAMPLE 3

| | % by weight |
|---|---|
| Sodium Hydroxide | 30.0 |
| Sodium Metasilicate | 30.0 |
| Sodium Carbonate | 20.0 |
| Sodium Gluconate | 10.0 |
| EDTA, Tetrasodium Salt Dihydrate | 2.5 |
| Linear Primary Alcohol Polyether (Cloud Point About 40° C.) | 3.0 |
| Linear Primary Alcohol Polyether (Cloud Point About 26° C.) | 1.5 |
| Linear Alcohol Alkoxylate (Cloud Point About 20° C.) | 1.0 |
| Deodorized Kerosine | 2.0 |
| | 100.0 |

This formulation was added to water in an amount equivalent to 2 ounces per gallon. The aqueous working solution was placed in an industrial size power washer spray cleaning unit equipped with a tank capacity of 2,000 gallons and driven with a 30 horse power pump having a capacity of 870 gallons per minute. Farm machinery parts fabricated of cold steel, and highly soiled, were cleaned for 90 seconds at a temperature of about 38° C. A conventional cleaner for comparable results, required a concentration equivalent of 4 ounces per gallon and treatment at a temperature of 71° C.

EXAMPLE 4

| | % by weight |
|---|---|
| Sodium Metasilicate | 60.0 |
| Sodium Carbonate | 18.5 |
| Sodium Gluconate | 5.0 |
| EDTA, Tetrasodium Salt Dihydrate | 3.0 |
| Linear Primary Alcohol Polyether (Cloud Point About 40° C.) | 6.0 |
| Linear Primary Alcohol Polyether (Cloud Point About 26° C.) | 3.0 |
| Linear Alcohol Alkoxylate (Cloud Point About 20° C.) | 2.0 |
| Deodorized Kerosine | 2.5 |
| | 100.0 |

This formulation was added to water at a concentration of 4 ounces 25 per gallon. The working solution was placed in a mechanically agitated immersion tank consisting of an impellar pump causing counter-flow of the cleaning solution on machine parts made of either cast iron or aluminum. The parts were coated with machining oils and lubricants, and were effectively cleaned in the working solution in a period of 5 minutes at a temperature of only 49° C.

EXAMPLE 5

| | % by weight |
|---|---|
| Sodium Hydroxide | 20.0 |
| Sodium Metasilicate | 40.0 |

-continued

| | % by weight |
|---|---|
| Sodium Carbonate | 18.0 |
| Sodium Gluconate | 9.0 |
| EDTA, Tetrasodium Salt Dihydrate | 3.0 |
| Linear Primary Alcohol Polyether (Cloud Point About 40° C.) | 2.1 |
| Linear Primary Alcohol Polyether (Cloud Point About 26° C.) | 3.5 |
| Linear Alcohol Alkoxylate (Cloud Point About 20° C.) | 1.4 |
| Deodorized Kerosine | 3.0 |
| | 100.0 |

This formulation was added to water at a concentration equivalent to 1 ounce per gallon, with the working solution being then passed through a spray washer. The working solution was maintained at a temperature of approximately 32° C., and the material was used to clean cold-rolled steel stampings and aluminum die castings. The parts were effectively cleaned in a period of only 2 minutes, where previous experience required an initial separation of the metallic components, and an operating temperature of approximately 82° C., with a similar time requirement being involved.

E. General Working Solutions

In the preparation of working solutions utilizing the formulation of the present invention, effectiveness is found when concentrations within the following range are employed:

| | Effective Range (% by weight) |
|---|---|
| Sodium Hydroxide | 0.00 - 2.40 |
| Sodium Metasilicate | 0.42 - 3.60 |
| Sodium Carbonate | 0.28 - 2.40 |
| Sodium Gluconate | 0.11 - 0.90 |
| EDTA, Tetrasodium Salt Dihydrate | 0.04 - 0.30 |
| Linear Primary Alcohol Polyether (Cloud Point About 40° C.) | 0.04 - 0.36 |
| Linear Primary Alcohol Polyether (Cloud Point About 26° C.) | 0.02 - 0.18 |
| Linear Alcohol Alkoxylate (Cloud Point About 20° C.) | 0.01 - 0.12 |
| Deodorized Kerosine | 0.02 - 0.18 |

I claim:

1. Metal cleaning composition comprising a formulation for preparing aqueous metal cleaning and polishing baths, with the formulation including:

a. an alkaline builder which consists of sodium metasilicate together with an alkaline ingredient selected from the group consisting of sodium hydroxide, sodium carbonate, and mixtures thereof, with said alkaline builder being present in the formulation in an amount equivalent to between about 55 percent and 65 percent by weight of said formulation;

b. sodium gluconate in an amount equivalent to between about 5 percent and 15 percent by weight of said formulation;

c. the tetrasodium salt of ethylenediaminetetraacetic acid (dihydrate) in an amount equivalent to between about 1.5 percent and 5 percent by weight of said formulation;

d. kerosine, a distilled hydrocarbon having a boiling point of between about 150° C. and 300° C. in an amount equivalent to between about 1.5 percent and 3 percent by weight of said formulation; and e. a biodegradable wetting agent system consisting of a mixture of first and second linear primary alcohol polyethers and a linear alcohol alkoxylate wherein said first linear primary alcohol polyether has a cloud point of about 40° C. said second linear primary alcohol polyether has a cloud point of about 26° C., and said linear alcohol alkoxylate has a cloud point of about 20° C., and wherein the weight ratios of said first linear primary alcohol polyether to said second linear primary alcohol polyether to said linear alcohol alkoxylate ranges from between about 1.5–6.0:1.5–3.5:1.0–2.0.

2. The metal cleaning composition as defined in claim 1 being particularly characterized in that said weight ratio is approximately 3.0:1.5:1.0.

3. Metal cleaning composition comprising a formulation for preparing aqueous metal cleaning and polishing baths, with the formulation including:

a. an alkaline builder which consists of sodium metasilicate together with an alkaline ingredient selected from the group consisting of sodium hydroxide, sodium carbonate, and mixtures thereof, with said alkaline builder being present in the formulation in an amount equivalent to between about 55 percent and 65 percent by weight of said formulation;

b. sodium gluconate in an amount equivalent to between about 5 percent and 15 percent by weight of said formulation;

c. the tetrasodium salt of ethylenediaminetetraacetic acid (dihydrate) in an amount equivalent to between about 1.5 percent and 5 percent by weight of said formulation;

d. kerosine, a distilled hydrocarbon having a boiling point of between about 150° C. and 300° C. in an amount equivalent to between about 1.5 percent and 3 percent by weight of said formulation; and e. a biodegradable wetting agent system consisting of a mixture of first, second, and third surfactants each selected from the group consisting of linear primary alcohol polyethers and linear alcohol alkoxylates, and wherein the first surfactant has a cloud point of about 40° C., the second surfactant has a cloud point of about 26° C., and the third surfactant has a cloud point of about 20° C.

* * * * *